US008156924B2

(12) United States Patent
Hudak et al.

(10) Patent No.: US 8,156,924 B2
(45) Date of Patent: Apr. 17, 2012

(54) SYSTEMS AND METHODS FOR REGULATING PURGE FLOW RATE IN AN INTERNAL COMBUSTION ENGINE

(75) Inventors: Eric B. Hudak, Sheboygan, WI (US); Terrence M. Rotter, Sheboygan Falls, WI (US); Nathan R. Vogt, Elkhart Lake, WI (US)

(73) Assignee: Kohler Co., Kohler, WI (US)

( * ) Notice: Subject to any disclaimer, the term of this patent is extended or adjusted under 35 U.S.C. 154(b) by 363 days.

(21) Appl. No.: 12/251,588

(22) Filed: Oct. 15, 2008

(65) Prior Publication Data

US 2009/0100828 A1 Apr. 23, 2009

Related U.S. Application Data

(60) Provisional application No. 60/980,658, filed on Oct. 17, 2007.

(51) Int. Cl.
*F02M 33/02* (2006.01)

(52) U.S. Cl. ..... 123/520

(58) Field of Classification Search ..... 123/516, 123/518–520

See application file for complete search history.

(56) References Cited

U.S. PATENT DOCUMENTS

| | | | | |
|---|---|---|---|---|
| 3,289,711 | A | 12/1966 | Hall | |
| RE26,169 | E | 3/1967 | Hall | |
| 3,393,669 | A | 7/1968 | Vardi et al. | |
| 3,683,597 | A | 8/1972 | Beveridge et al. | |
| 4,279,233 | A | 7/1981 | Tobita et al. | |
| 4,475,522 | A | 10/1984 | Oonaka | |
| 4,849,604 | A * | 7/1989 | Woolcott | 219/207 |
| 5,570,672 | A | 11/1996 | Kunimitsu et al. | |
| 5,592,922 | A | 1/1997 | Denz | |
| 5,623,911 | A | 4/1997 | Kiyomiya et al. | |
| 5,630,403 | A | 5/1997 | Van Kampen | |
| 5,635,630 | A * | 6/1997 | Dawson et al. | 73/40.5 R |
| 5,769,057 | A | 6/1998 | Hashimoto et al. | |
| 5,806,500 | A | 9/1998 | Fargo et al. | |
| 5,826,566 | A * | 10/1998 | Isobe et al. | 123/520 |
| 5,970,958 | A * | 10/1999 | DeLand et al. | 123/520 |
| 6,058,913 | A | 5/2000 | Busato | |

(Continued)

FOREIGN PATENT DOCUMENTS

DE 3122883 A1 * 1/1983

(Continued)

*Primary Examiner* — Hai Huynh

(74) *Attorney, Agent, or Firm* — Whyte Hirschboeck Dudek S.C.

(57) ABSTRACT

A system and method of controlling/adjusting purge flow rate in an internal combustion engine is disclosed. The system includes an air intake assembly, a fuel tank assembly and an evaporative emissions control device such as a carbon canister in operational association with each other. Fuel vapors from the fuel tank assembly flow into the evaporative emissions control device for adsorption. The adsorbed fuel vapors from the evaporative emissions control device are recovered, at least in part due to pressure differentials, and actively purged into the internal combustion engine. The purge flow rate from the evaporative emissions control device is controlled/adjusted by a flow control device, the flow control device that is at least indirectly connected to the evaporative emissions control device and the air intake assembly. In one aspect, the flow control device can comprise an orifice device, such as, a connector device having at least one orifice for regulating purge flow rate. In another aspect, the flow control device can comprise a filter device for cleaning the intake and/or purged air in addition to regulating the purge flow rate.

26 Claims, 10 Drawing Sheets

U.S. PATENT DOCUMENTS

| | | | | |
|---|---|---|---|---|
| 6,460,516 | B2 | 10/2002 | Kimoto et al. | |
| 6,503,301 | B2 | 1/2003 | Uchino et al. | |
| 6,540,815 | B1 | 4/2003 | Hiltzik et al. | |
| 6,814,061 | B2 * | 11/2004 | Everingham | 123/520 |
| RE38,844 | E | 10/2005 | Hiltzik et al. | |
| 6,955,159 | B2 | 10/2005 | Ogawa | |
| 6,959,696 | B2 | 11/2005 | Shears et al. | |
| 7,008,470 | B2 | 3/2006 | Makino et al. | |
| 7,011,076 | B1 * | 3/2006 | Weldon et al. | 123/516 |
| 7,047,952 | B1 * | 5/2006 | Yamauchi et al. | 123/519 |
| 7,159,577 | B2 | 1/2007 | Haskew et al. | |
| 7,267,112 | B2 | 9/2007 | Donahue et al. | |
| 7,647,920 | B2 * | 1/2010 | Amano et al. | 123/519 |
| 2002/0036015 | A1 | 3/2002 | Miyajima | |
| 2004/0261777 | A1 | 12/2004 | Ogawa | |
| 2005/0178368 | A1 | 8/2005 | Donahue et al. | |
| 2009/0071123 | A1 * | 3/2009 | Tomazic et al. | 60/274 |
| 2009/0277427 | A1 * | 11/2009 | Yoshimura | 123/520 |
| 2009/0288645 | A1 * | 11/2009 | Childress et al. | 123/520 |
| 2010/0094493 | A1 * | 4/2010 | Atsumi | 701/22 |

FOREIGN PATENT DOCUMENTS

| | | | |
|---|---|---|---|
| EP | 1548270 | A1 | 6/2005 |
| JP | 2001-152979 | | 6/2001 |

* cited by examiner

SYSTEMS AND METHODS FOR REGULATING PURGE FLOW RATE IN AN INTERNAL COMBUSTION ENGINE

CROSS-REFERENCE TO RELATED APPLICATIONS

This application claims the benefit of U.S. provisional patent application No. 60/980,658 entitled "systems and methods for regulating purge flow rate in an internal combustion engine" filed on Oct. 17, 2007, which is hereby incorporated by reference herein.

FIELD OF THE INVENTION

The present invention relates to internal combustion engines and, more particularly, to evaporative emissions control systems and methods employed in internal combustion engines.

BACKGROUND OF THE INVENTION

Small internal combustion engines are used in a wide variety of applications including for example, lawn mowers, lawn tractors, snow blowers and power machinery. It is common to find that such internal combustion engines employ a carburetor to provide an appropriate air/fuel mixture (also called "charge") to the combustion chamber of the internal combustion chamber. Frequently, carburetors of such internal combustion engines are connected via a supply line to a fuel tank that store fuels such as gasoline, diesel fuel and other types of liquid fuels used by the engines. Typically, fuel enters the carburetor from the fuel tank at least in part due to pressure differentials between the fuel tank and the venturi region of the carburetor. The fuel is mixed with air within the venturi region of the carburetor.

When situated within a fuel tank, certain amounts of a liquid fuel typically become vaporized as hydrocarbons, particularly when temperatures within the tank rises, when the tanks experience high levels of jostling, and/or when the volume within the tank unoccupied by fuel (and filled with air) becomes rather large relative to the air space. The vaporization of fuel continues even during the normal course of storage of the fuel within the fuel tank.

Fuel vapors emanating from the fuel tanks of internal combustion engines are a main contributor to evaporative emissions from such engines. Such emissions from fuel tanks can occur particularly when passage(s) are formed that link the interior of the fuel tank with the outside atmosphere, for example, for venting purposes as well as when refueling occurs. Because fuel vapors can contribute to ozone and urban smog and otherwise negatively impact the environment, increasingly it is desired that these evaporative emissions from fuel tanks be entirely eliminated or at least reduced. In particular, legislation has recently been enacted (or is in the process of being enacted) in various jurisdictions such as California placing restrictions on the evaporative emissions of Small Off Road Engines (SORE), such as those employed in various small off-road vehicles and other small vehicles that are used to perform various functions in relation to the environment, for example, lawn mowers and snow blowers.

For at least these reasons, therefore, it would be advantageous if an improved system/device and/or method could be created to prevent or reduce evaporative emissions from fuel tanks, such as the fuel tanks of internal combustion engines including, for example, SORE engines.

BRIEF SUMMARY OF THE INVENTION

In one aspect, the present invention relates to an evaporative emissions system for adjusting and/or controlling the purge flow rate of evaporative fuel vapors from a carbon canister in an internal combustion engine. The system includes an air intake assembly comprising an air filter, carburetor and an intake manifold in operational association with each other. The system also includes an evaporative emissions control device that is in fluid communication with the air intake assembly. The system further includes a fuel tank assembly in fluid communication with both, the evaporative emissions control device and the air intake assembly, and a housing that is capable of storing liquid fuels as well as an air space above the upper surface of the liquid fuel. The liquid fuel stored within the housing is additionally capable of evaporation producing fuel vapors comprising volatile organic compounds (VOC), which collect in the air space above the liquid fuel. The fuel vapors from the housing flow into the evaporative emissions control device and are subsequently purged into the internal combustion engine. In one embodiment, the purge rate of the fuel vapors can be regulated by a flow control device connected at least indirectly to the evaporative emissions control device and the air intake assembly. The flow control device further includes at least one of an orifice and a passageway, at least one of the orifice and the passageway sized in relation to the evaporative emissions control device and the fuel tank assembly.

In another aspect, a method for regulating purge flow rate into an internal combustion engine is disclosed. The method comprises providing an air intake assembly, an evaporative emissions control device and a fuel tank assembly in operational association with each other. A flow control device connected at least indirectly to the evaporative emissions control device and the air intake assembly is also provided. The method for regulating the purge flow rate can further comprise receiving fuel vapors at least indirectly from the fuel tank assembly into the evaporative emissions control device and purging the received fuel vapors into the internal combustion engine using the flow control device.

And in another aspect, the flow control device can comprise an orifice device, and more specifically, a connector device, having a channel section having a channel for receiving fuel vapors. Additionally, the channel terminates in at least one orifice to regulate purge flow rate.

In yet another aspect, the flow control device can comprise a filter device connected at least indirectly to the evaporative emissions control device and the air intake assembly. The filter device is used for cleaning the intake and/or purged air in addition to regulating the purge flow rate.

Other aspects and embodiments are contemplated and considered within the scope of the invention.

BRIEF DESCRIPTION OF THE DRAWINGS

Embodiments of the invention are disclosed with reference to the accompanying drawings and these embodiments are provided for illustrative purposes only. The invention is not limited in its application to the details of construction or the arrangement of the components illustrated in the drawings. Rather, the invention is capable of other embodiments and/or of being practiced or carried out in other various ways. The drawings illustrate a best mode presently contemplated for carrying out the invention. Like reference numerals are used to indicate like components. In the drawings.

DETAILED DESCRIPTION OF THE PREFERRED EMBODIMENTS

Figure 1A:
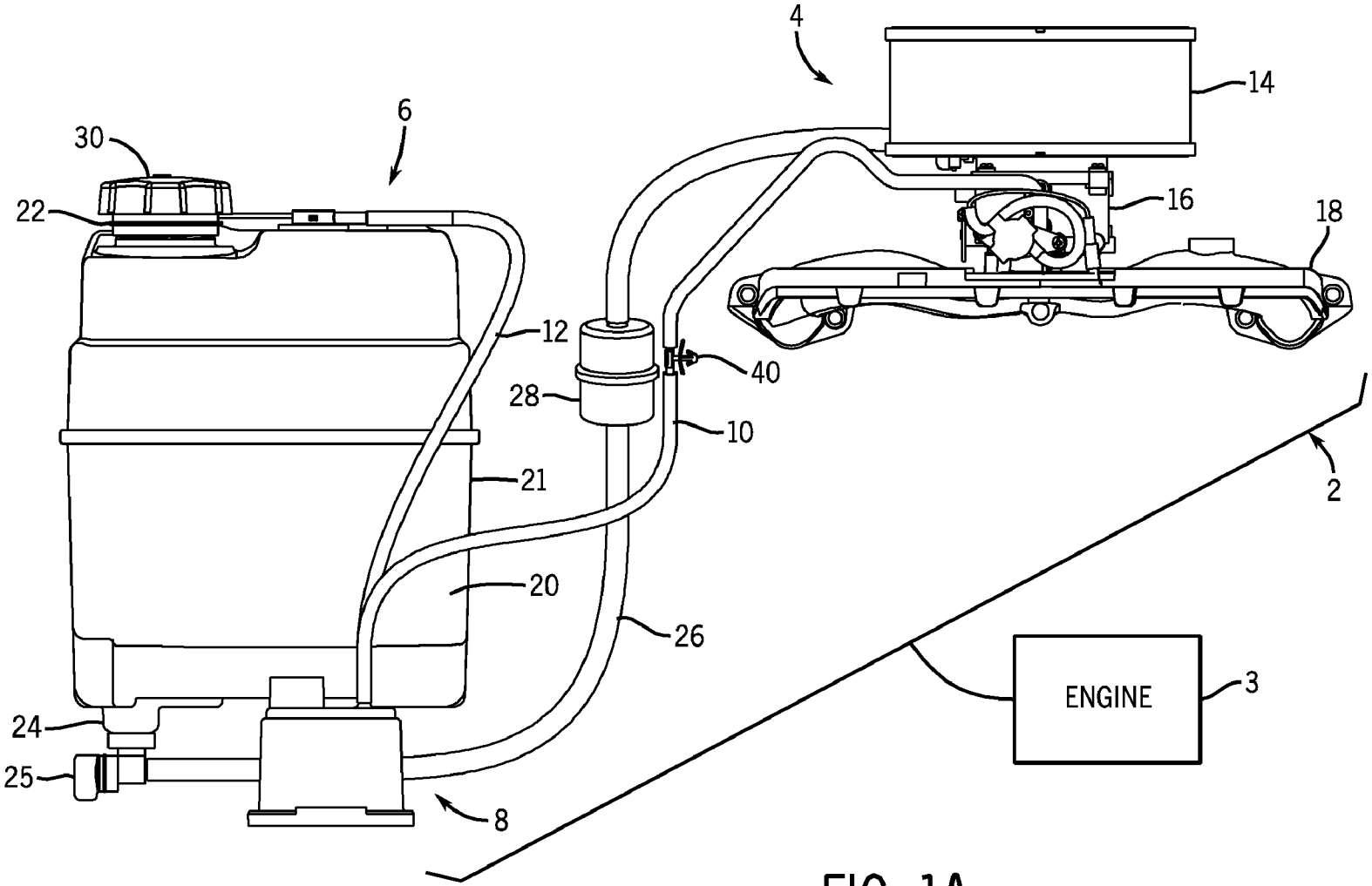
FIG. 1A is a front view of an evaporative emissions control system utilizing a flow control device in accordance with at least some embodiments of the present invention.
Figure 1B:
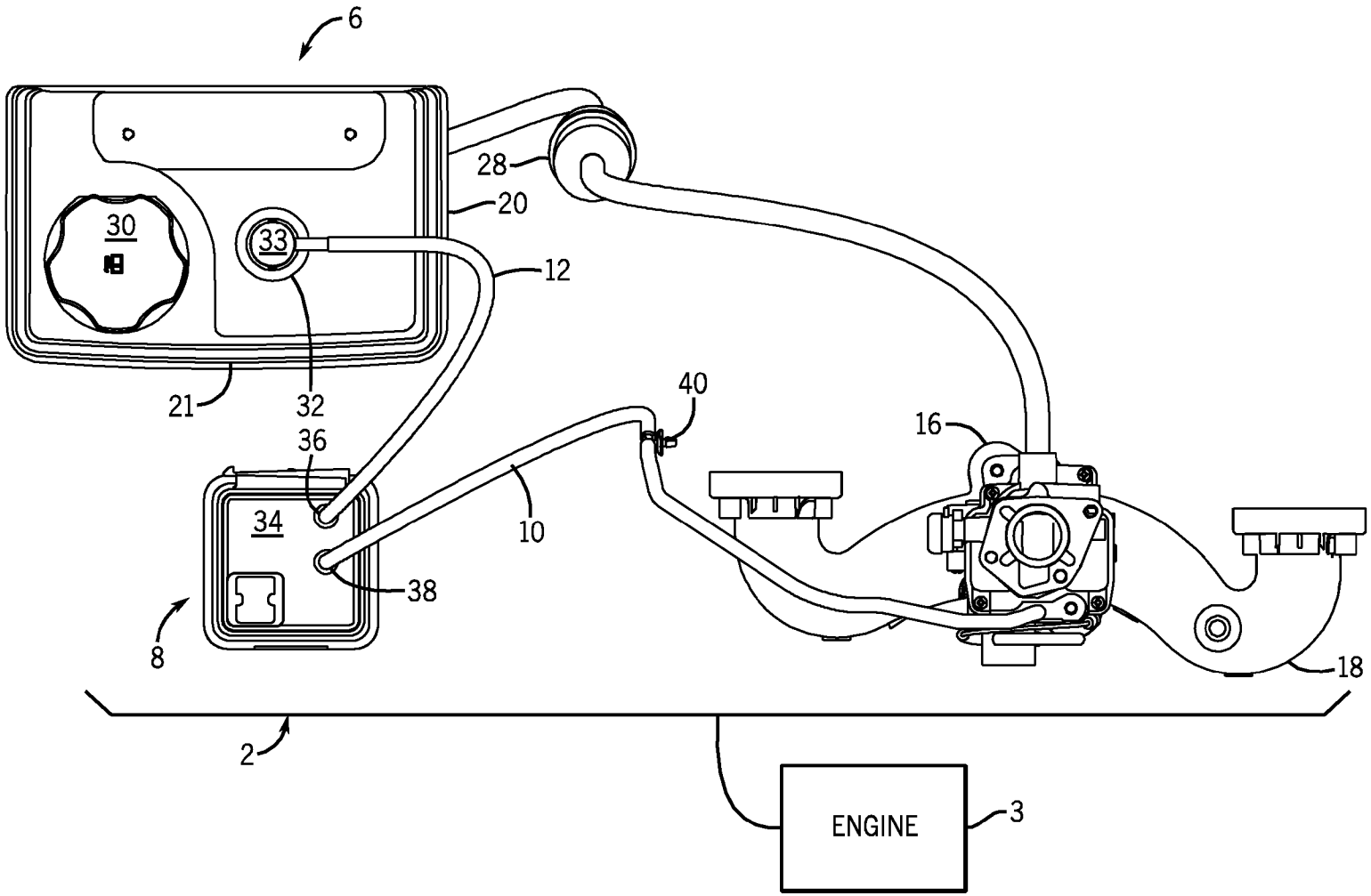
FIG. 1B is a top plan view of the system of FIG. 1A.

Referring to FIGS. 1A and 1B, front and top views, respectively, of an evaporative emissions control system, generally referenced by the numeral 2, are shown in accordance with at least some embodiments of the present invention. The evaporative emissions control system 2 is contemplated for use in, as part of, or in conjunction or combination with an engine 3. In particular, the engine 3 can be any of a wide variety of engines. For example, some embodiments of the present invention can be employed in conjunction with SORE engines including Class 1 and Class 2 small off-road engines such as those implemented in various machinery and vehicles, including, for example, lawn movers, air compressors, and the like. Indeed, in at least some such embodiments, the present invention is intended to be applicable to "non-road engines" as defined in 40 C.F.R. §90.3, which states in pertinent part as follows: "Non-road engine means . . . any internal combustion engine: (i) in or on a piece of equipment that is self-propelled or serves a dual purpose by both propelling itself and performing another function (such as garden tractors, off-highway mobile cranes, and bulldozers); or (ii) in or on a piece of equipment that is intended to be propelled while performing its function (such as lawnmowers and string trimmers); or (iii) that, by itself or in or on a piece of equipment, is portable or transportable, meaning designed to be and capable of being carried or moved from one location to another. Indicia of transportability include, but are not limited to, wheels, skids, carrying handles, dolly, trailer, or platform."

Additionally, the evaporative emissions control system 2 includes an air intake assembly 4, a fuel tank assembly 6 and an evaporative emissions control device 8, each in operational association with one another. The air intake assembly 4 and the fuel tank assembly 6 are in fluid communication with the evaporative emissions control device 8 via a purge line 10 and a vapor line 12, respectively. The air intake assembly 4 conveys air from the outside atmosphere to the combustion chamber (not shown) of the engine for expansion and ignition. As air travels through the air intake assembly 4, air and fuel are mixed together to produce an air/fuel mixture, also called charge, which is delivered to the combustion chamber.

With reference still to FIGS. 1A and 1B, the air intake assembly 4 includes an air filter 14, a carburetor 16 and an intake manifold 18. Air from the outside enters the air intake assembly 4 through the air filter 14. While the various components of the air filter 14 are not shown in detail in FIGS. 1A and 1B, a typical air filter of the kind that can be used with the present invention as illustrated includes a filter housing (not shown) having air inlet and outlet ends. Air typically enters the filter housing via the air inlet ends and passes through a filtering media located within an inner chamber of the filter housing. By virtue of the air passing through the filtering media, dust, debris, dirt and other particles are filtered from the air resulting in clean, or substantially clean, air that passes into the carburetor 16 through the outlet ends of the air filter 14. An optional evaporative valve can be present downstream of the air filter 14 in alternate embodiments for preventing fuel vapors from the carburetor 16 from being vented to the outside atmosphere through the air filter 14 when the engine is not in operation.

Although all the internal components of the carburetor 16 are not shown in FIGS. 1A and 1B, a typical carburetor of the kind that can be used in the present invention as illustrated includes at least the following components described below. The carburetor 16 is typically located downstream of the air filter 14 and is at least indirectly coupled to the air filter for receiving intake air from the air filter. Clean air from the air filter 14 enters the carburetor 16 and is transported into a narrow throat region for combining with fuel to produce charge for delivery to the combustion chamber. The throat region of the carburetor 16 in particular, includes a narrow, constricted venturi region for mixing air and fuel together. Fuel is drawn into the venturi region through a fuel nozzle connected to the fuel tank assembly 6, as discussed in more detail below. The fuel nozzle is generally located proximate to the throat region and fuel enters the venturi region due to pressure differentials arising from the venturi action within the venturi region as air passes through the region during running of the engine.

Disposed additionally downstream of the venturi region is a throttle value configured to control the flow of charge through the carburetor. The charge exiting the carburetor 16 enters the intake manifold 18 in a manner well known in the art. The intake manifold 18 then communicates the charge for ignition to the combustion chamber of the engine located downstream of the intake manifold (not shown).

The fuel tank assembly 6 includes a fuel tank 20 having a housing 21 and an input port 22. The shape and size of the fuel tank 20, as well as the material from which the housing 21 is constructed, can vary to convenience depending upon a number of factors, including: a) the internal combustion engine with which the fuel tank housing is used, b) the particular application for the engine, and c) the type of fuel that is stored or housed within the fuel tank housing. Typically, liquid fuel that is capable of evaporation at normal temperatures and pressures, such as gasoline, is stored within the fuel tank 20. In accordance with various embodiments of the invention, the fuel from the fuel tank 20 flows towards the carburetor 16 through an output port 24 via a fuel line 26. The fuel line 26 is coupled to the carburetor 16, typically to a fuel nozzle within the carburetor throat region (not shown). As a result, fuel is drawn into the venturi region from the fuel tank 20 through the fuel line 26. A fuel shut-off valve 25 can be present at the junction of the output port 24 and the fuel line 26. By virtue of the device (e.g., a fuel shut-off valve), the flow of fuel from the fuel tank 20 can be controlled. Optionally, a fuel filter 28 can be attached to the fuel line 26 for filtering dust and debris from the liquid fuel.

With reference still to FIGS. 1A and 1B, the input port 22 of the fuel tank 20 is sealably engaged by a fuel tank cap 30, which allows for opening or closing the fuel tank. Typically, the fuel tank cap 30 is a removable cap having internal threads that engage with the external threads of the input port 22. It should be understood that the fuel tank cap 30 provided is only exemplary and variations and alternatives are considered within the scope of the invention. For example, in some applications, the cap threads (not shown) can be external as opposed to internal. Additional sealing in the form of gaskets can be provided between the fuel tank cap 30 and the input port 22 such that atmospheric air from the outside cannot enter the fuel tank 20 and fuel vapors on the inside are prevented from being vented to the outside. Fuel vapors comprising of hydrocarbons (i.e., vaporized fuel and residual gases) collect in an air space above the upper surface of the liquid fuel due to a wide variety of reasons including, for example, fuel evaporation at high temperatures and jostling of the fuel tank 20 during operation of the engine. Such collected fuel vapors are eventually vented to the outside as the fuel cap is opened (for e.g., for re-fuelling) leading to undesirable evaporative emissions and fuel waste.

To minimize or possibly even completely eliminate the fuel vapors from being vented to the outside, the fuel tank 20 has formed thereon, or otherwise includes, a vent opening 32 (See FIG. 1B) adjacent to the input port 22. The vent opening 32 is coupled to one end of the vapor line 12, and conveys fuel vapors from within the fuel tank 20 to the evaporative emissions control device 8. By virtue of the vent opening 32 being connected to the vapor line 12 and fuel vapors flowing into the evaporative emissions control device 8 through the vapor line, fuel vapors are trapped or otherwise contained within the evaporative emissions control device. In this fashion, evaporative emissions are controlled (this is explained in more detail below). The vent opening 32 can optionally be equipped with a roll-over valve 33 (See FIG. 1B), or other suitable mechanism, positioned over the vent opening and the valve or other mechanism prevents the liquid fuel within the fuel tank 20 from flowing through the vapor line 10 and into the evaporative emissions control device 8.

The evaporative emissions control device 8 of the present embodiment is typically a conventional canister or canister-type device (e.g., a carbon canister) that is in fluid communication with the air intake assembly 4 and the fuel tank assembly 6 and is also linked to the outside atmosphere. The evaporative emissions control device 8 in particular can be a separate stand-alone component coupled to the air filter 14, the carburetor 16, the intake manifold 18, or any other suitable component of the internal combustion engine. Alternatively, it is contemplated that the device 8 may be integrated into any of these or other components. The functionality of the evaporative emissions control device 8 is at least two-fold. First, the evaporative emissions control device 8 traps fuel vapors (i.e., containing a vaporized fuel component and the residual gases) from the fuel tank 20 to reduce evaporative emissions and purges those fuel vapors into the engine when the engine is running. Alternatively, when the engine is not running, the evaporative emissions control device 8 serves to trap the fuel vapors and recover the trapped fuel component from the fuel vapors for actively purging the recovered fuel into the engine and expelling any residual gases (e.g., air or fresh air) into the atmosphere. By virtue of the purging action of the evaporative emissions control device 8, as well as the expulsion of the residual gases (when the engine is not running), undesirable evaporative emissions, as well as fuel wastage, are both reduced.

For trapping and purging purposes, the evaporative emissions control device 8 includes a canister housing 34. The housing typically includes a chamber with a wall extending at least partially therein, and the wall provides a U-shaped cross-section of the chamber or interior of the canister housing. A plurality of ports (see FIG. 1B), including a fuel tank port 36, a purge port 38 and a fresh air port (not shown), are typically are formed on, or are otherwise provided by, the canister housing 34. In the present embodiment, all these ports are located on one side or one end of the canister housing 34 (as can be seen in FIG. 1B). However, it shall be understood that the exact location and/or orientation of the various ports can vary to convenience depending, for example, upon the location of the evaporative emissions control device 8 within the internal combustion engine or its location with respect to other system components or assemblies. In particular, the fresh air port is used for transporting fresh air from the outside to the inside for assisting in the purging action. The fresh air port is additionally employed for expelling any residual gases (e.g., gases without any or substantially any fuel component) into the atmosphere when the engine is not running. The purge port 38 connects the evaporative emissions control device 8 to the air intake assembly 4 for actively purging the fuel vapors into the engine. In other words, when the engine is running, the fuel vapors, including the air (or fresh air) are ingested into the engine. When the engine is not running, the fuel vapors are captured in the evaporative emissions control device 8 and the residual gasses (e.g., air without the fuel component of the fuel vapors) get expelled through the fresh air port to the atmosphere. The fuel port 36 receives fuel vapors containing hydrocarbons from the fuel tank 20 for adsorption.

Adsorption of the fuel vapors within the evaporative emissions control device 8 is performed by way of an adsorbent media, such as, by way of example and not limitation, activated charcoal, or carbon pellets, located within the canister housing 34. Although, charcoal is a frequently used adsorbent media, other adsorbent media that are commonly available can potentially be used. The charcoal adsorbent material within the carbon canister is generally rated by its Normal Butane Capacity (NBC) measured in grams/milliliter. A typical NBC rating for such a media is 10 although carbon having other ratings is commercially available and can be used. In one embodiment, the evaporative emissions control device 8 includes only a single variety of the adsorbent material having a single evaporated adsorption fuel level (for e.g., the NBC rating). Nevertheless, in other embodiments, one or more additional or other types of adsorbent materials, each having different evaporated adsorption fuel levels, can be used.

One way of controlling evaporative emissions for SORE engines is by utilizing carbon canisters (of the kind described above) to trap the vented hydrocarbons from the fuel tank 20. The evaporative emissions control device sizes are typically determined based upon the volumetric capacity of the fuel tank 20 of the internal combustion engine. For example, a typical ratio of the quantity of liquid fuel within the fuel tank 20 to the adsorbent material within the canister housing 34 is 1.4 grams of hydrocarbon working capacity per liter of the size of the fuel tank 20 (1.4 g HC W.C./L fuel tank). However, the foregoing can be varied depending upon the NBC rating of the carbon used within the adsorbent media of the evaporative emissions control device 8. Generally, an internal combustion engine model can be used for a wide variety of applications requiring a variety of fuel tank sizes thereby resulting in a wide variety of designs and sizes of the evaporative emissions control device 8, all for achieving optimum purge flow rates.

Due to the various sizes and designs of the carbon canisters, the purge rate and concentration of hydrocarbons in the purge air can vary, resulting in varying engine performances. To prevent the engine performance from changing due to change in carbon canisters, it is often required that the carburetor be re-calibrated. Re-calibration of the carburetor can be an inconvenient, time consuming and a costly operation. Advantageously, the present invention provides flow control devices (discussed below) that are capable of controlling the purge flow rate without the requirement of re-calibrating the carburetor to obtain optimum engine performance, even while including varying carbon canisters (e.g., canisters of different sizes and designs).

Figure 2:
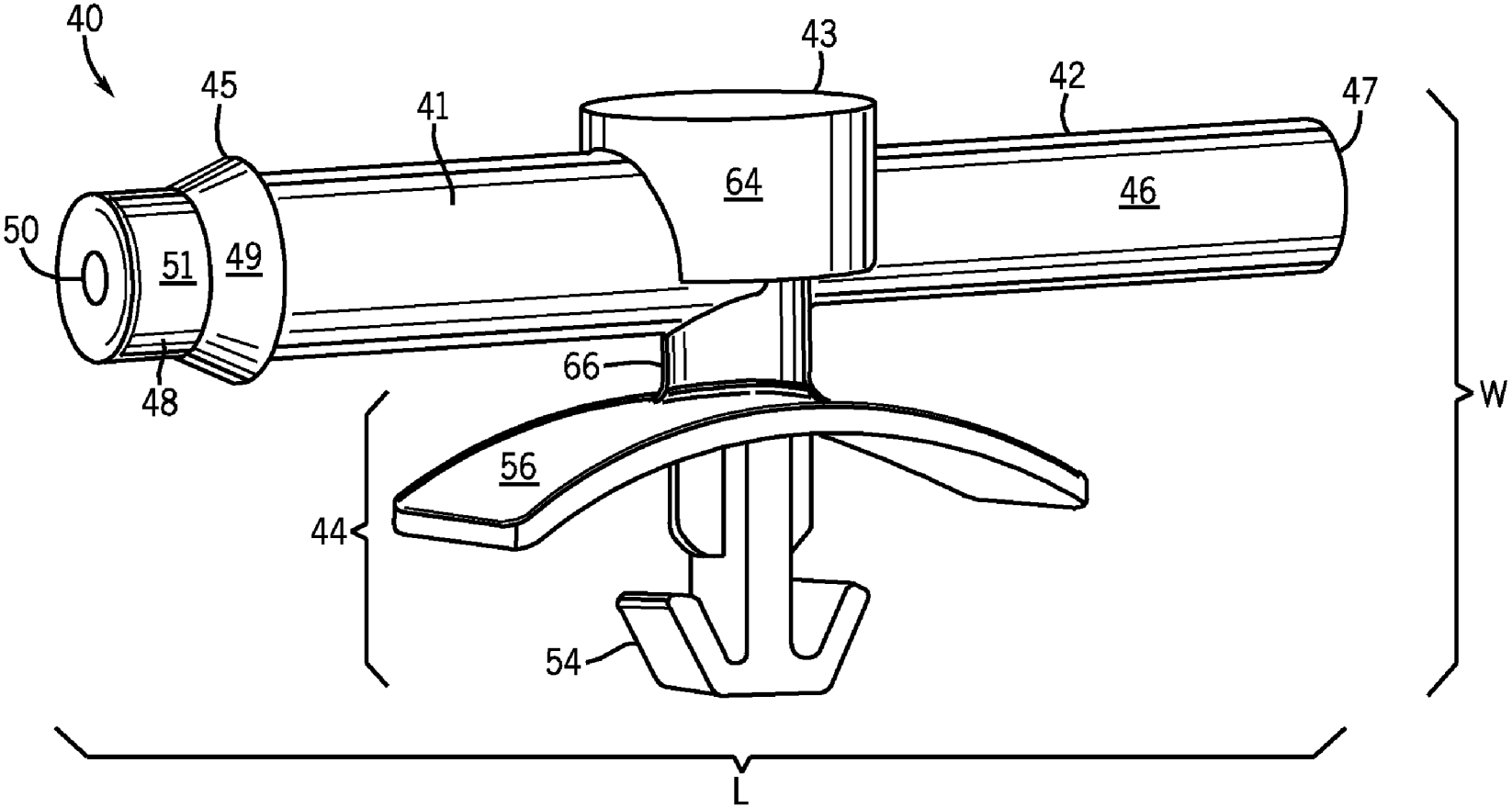
FIG. 2 is a side perspective view of a first embodiment of the flow control device, which when used in conjunction with, for example, the system of FIG. 1A, is capable of controlling the purge flow rate of evaporative emissions, in accordance with at least some embodiments of the present invention.

Referring now to FIG. 2, a first embodiment of a flow control device 40 is shown in accordance with at least some embodiments of the present invention. Further, in at least some preferred embodiments of the present invention, the first embodiment of the flow control device 40 is an orifice connector 41 used in conjunction with the evaporative emissions control system 2, as shown from a side perspective view in FIG. 2. More generally, the orifice connector can be referred to as, or termed, an "orifice device". Using the flow control device 40 of the kind shown (e.g., the orifice connector 41) connected at least indirectly to the evaporative emissions control device 8 and the air intake assembly 4, the purge flow rate can be regulated (explained in greater detail below). The orifice connector 41 is typically placed on the purge line 10, although the location of the orifice connector 41 on the purge line can vary. In general, the first embodiment of the flow control device 40 employing the exemplary orifice connector 41 includes an orifice, sized so as to regulate the purge flow rate, as will be described in greater detail below.

The flow control device 40, and more specifically the orifice connector 41 shown, can typically be connected to the purge line 10 in a variety of ways. For example, the orifice connecter 41 can be connected by severing or otherwise disconnecting a small section of the purge line and connecting the orifice connector to the disconnected ends of the purge line. Alternatively, the respective line (e.g., the purge line) can be provided in a plurality (e.g., two) of portions and the portions connected together using the orifice connector. Various other connecting and engaging options and/or methods are contemplated and considered within the scope of the present invention. As shown, the orifice connecter 41 is a T-shaped (or substantially T-shaped) structure having first and second sections 42 and 44, respectively, connected together by way of a connection flange or flange-like section or a support section support member 43. Typically, the orifice connector 41 is made of molded plastic although other flexible or rigid materials or potentially even metals can be used. Additionally, the respective first and second sections 42 and 44 and the connection flange 43 may be formed as separate pieces coupled together in operational association or possibly as a unitary molded piece.

In general, the first section 42 of the orifice connector 41 includes a hollow cylindrical tube portion (or a channel section) 46 having first and second portions 45 and 47. In the present embodiment, the cylindrical tube 46 has smooth walls along its length and uniform dimensions. Further as shown in the present embodiment, portion 45 includes a barbed or barb-shaped portion 48, which serves as a receiving port for the fuel vapors coming from the evaporative emissions control device 8. Portion 47 has a regular circular contour and serves as an exit port for the fuel vapors flowing through the orifice connector 41 and headed towards the air intake assembly 4. It is contemplated that, in other embodiments, both portions 45 and 47 can potentially be extended to form barbed shaped portions.

Still referring to FIG. 2, the orifice connector 41 is typically placed along, or connected to, the purge line 10 (as shown in FIG. 1A) such that the barbed portion 48 provides a tight seal between the purge line and the orifice connector. Insofar as a tight seal between the purge line 10 and the orifice connector 41 is provided, fuel vapors can be prevented from escaping into the outside atmosphere during the purging action. The barbed shaped portion 48 is normally capped during shipping to prevent damage, as well as entry of undesirable particles or materials into the orifice connector 41 which might ultimately cause issues when the connecter is placed into use (e.g., blocking or obstructing the passage of the fuel vapors). Similar caps or covers can be present at the second portion 47 as well.

The barbed or barb-shaped portion 48 further includes a frusto-conical portion 49 adjacent to the first portion 45 and a cylindrical portion 51 having an orifice 50 and extending from the frusto-conical portion. Fuel vapors from the evaporative emissions control device 8 enter the orifice connector 41 through the orifice 50 and exit through the second portion 47. The orifice 50 is in fluid communication with a channel or hollow portion (hidden from view) of the cylindrical tube 46. As such, a clear and unobstructed passage for air flow from the barbed shaped portion 48 of the first portion 45 to the second portion 47 through the orifice of the cylindrical tube is formed. The orifice 50 is typically placed directly in-line with the purge line 10 to prevent any loss as fuel vapors travel from the evaporative emissions control device 8 to the air intake assembly 4.

Figure 3:
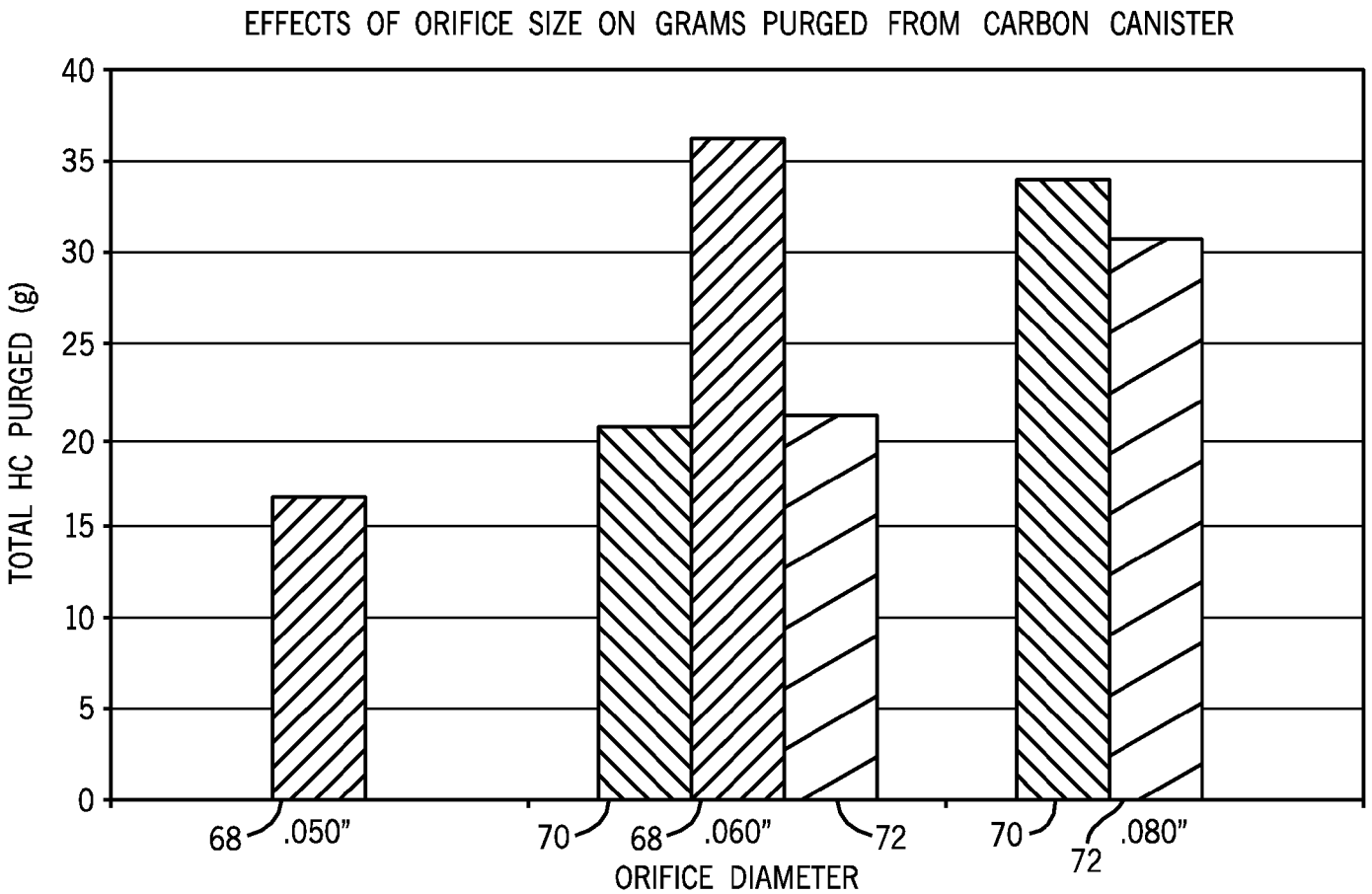
FIG. 3 is a graphical representation of the effect of connector orifice size on purge flow rate.

Additionally, the orifice 50 remains open at all times for regulating the purge flow rate of the evaporative emissions control device 8. Insofar as the orifice 50 remains open at all times, the orifice 50 does not employ a valve or a valve-like mechanism, which is capable of being opened and/or closed depending upon various conditions of the system within which the valve or the valve-like mechanism is employed. Furthermore, depending upon the size of the orifice 50, the amount of fuel vapors entering the orifice connector 41 can vary and be controlled. Therefore, by virtue of varying the orifice sizes as the sizes of the fuel tank 20 change, desired purge flow rates can be achieved. The variance of the purge flow rates with varying orifice sizes is shown in FIG. 3, described in more detail below. In particular, to achieve a desired purge flow rate, an orifice connector having an appropriately sized orifice can be connected to the purge line 10.

Still referring to FIG. 2, the second section (or the support section) 44 of the orifice connector 41 provides a support feature having an anchor-shaped portion 54 (having a flat arrow-like shape) and an arched member 56. In at least some embodiments of the present invention, the support feature of the second section 44 can be termed as a "rosebud" feature. In particular, the second section 44 permits the orifice connector 41 to semi-permanently attach to the purge line 10 while providing additional support to the orifice connector. The connection flange 43 provides support to the cylindrical tube 46 (especially to cylindrical tubes made of a flexible material) avoiding any bending that may result over time in course of the regular operation of the orifice connector 41. The connection flange 43 is a T-shaped structure having a broader cylindrical portion 64 surrounding the cylindrical tube 46 and a narrower tubular portion 66 that extends downwards from the broader portion to mate with the second section 44 through the arched member 56. The broader portion 64 provides support to the cylindrical tube 46 and further serves as a handle for holding the orifice connector 41. Generally, it should be understood that the other contours and/or shapes for the connector are contemplated and considered within the scope of the present invention.

Referring now to FIG. 3 in conjunction with FIG. 2, a graphical representation of the effect of orifice size of the orifice connector 41, which again is an exemplary orifice device provided in accordance with the first embodiment of the flow control device 40, on the purge rate of the fuel vapors is shown for different engine models. Shown are three different engine models, namely, first, second and third engines 68, 70 and 72 exemplifying engines SV720, SV610 and CH740, all of which are available from the Kohler Company of Kohler, Wis. As shown, as the orifice size (on the X-axis) is increased for a particular engine model, the amount of hydrocarbons purged (on the Y-axis) from the canister into the engine is also increased. For example, as the orifice size is increased from 0.050 inches to 0.060 inches for the first engine 68, the purge rate of the engine goes up from approximately 17 grams to 37 grams providing approximately a 118% increase with 0.010 inches increase in the orifice size. Similarly, for second and third engines 70 and 72 respectively, increase of the orifice size from 0.060 inches to 0.080 inches increases the purge rate of the second engine from approximately 21 grams to 34 grams while the third engine 72 experiences an increase in purge rate from 22 grams to 31 grams, an approximate increase of 62% and 41% respectively.

Therefore, increase in the purging rate of the hydrocarbons with the increase in the orifice size effectively illustrates that the orifice connector 41 can be used to "calibrate" the purge rate of the evaporative emissions control device 8 into the engine. It is noted again that the orifice connector 41 is an exemplary orifice device provided in accordance with the first embodiment of the flow control device and in accordance with at least some aspects of the invention. Advantageously, by virtue of the orifice connector 41 controlling the purge flow rate of the hydrocarbons, the only component that needs to be changed to accommodate various shapes and sizes of evaporative emissions control devices and fuel tanks is the orifice connector 41 itself. Therefore, the orifice connector 41 provides an easy and cost efficient medium of maintaining the engine performance without changing or substituting system or engine components, such as changing or substituting evaporative emission control devices (e.g., canisters), which can be costly and time-consuming.

In general, the dimensions of the orifice connector 41 can vary to convenience. In the present embodiment, the orifice connector 41 has a length "L" that is approximately 43 mm long and a width "W" of approximately 20 mm, although orifice connectors having other dimensions can be used as well in other embodiments. In at least some alternate embodiments of the present invention, the orifice of the first embodiment of the flow control device (e.g., the orifice connector 41) can be sized to have a diameter of 0.060 inches for an evaporative emissions control device 8 sized for a 5 gallon fuel tank 20. In some other embodiments, the orifice can be sized to have diameters in the range of 0.005 inches to 0.500 inches. In alternate embodiments, orifices having diameters other than those mentioned above can be used as well.

The location of the orifice connector 41, on the purge line 10 for controlling the purge flow rates of the fuel vapors from the evaporative emissions control device 8 during the "purging" action can vary, thereby resulting in the orifice being positioned in various locations. For example, as shown in FIG. 1, the flow control device 40 can be positioned intermediate (or substantially intermediate) between the evaporative emissions control device 8 and the carburetor 16. Other exemplary locations for the flow control device 40 are illustrated schematically in FIGS. 4A-4D. Referring to FIGS. 4A-4D, exemplary placement locations of the first embodiment of the flow control device 40 (e.g., the orifice connector/orifice device) on the purge line 10 within the evaporative emissions control system 2 are shown in accordance with at least some embodiments of the present invention. More specifically, FIGS. 4A-4D show (in schematic form) the components of the evaporative emissions control system 2 in operational association with one other. In particular, each of the FIGS. 4A-4D includes the air intake assembly 4, the fuel tank assembly 6, and the evaporative emissions control device 8 (e.g., a carbon canister). The air intake assembly 4 includes the air filter 14, the carburetor 16 and the intake manifold 18 coupled at least indirectly and capable of communication with each other. Additionally, the evaporative emissions control device 8 is in fluid communication with the air intake assembly 4 and the fuel tank assembly 6 by way of the purge line 10 and the vapor line 12, respectively. Connection of the connecter device to the respective lines or line portions at a respective location can be accomplished in a variety of ways as previously noted.

Figure 4A:
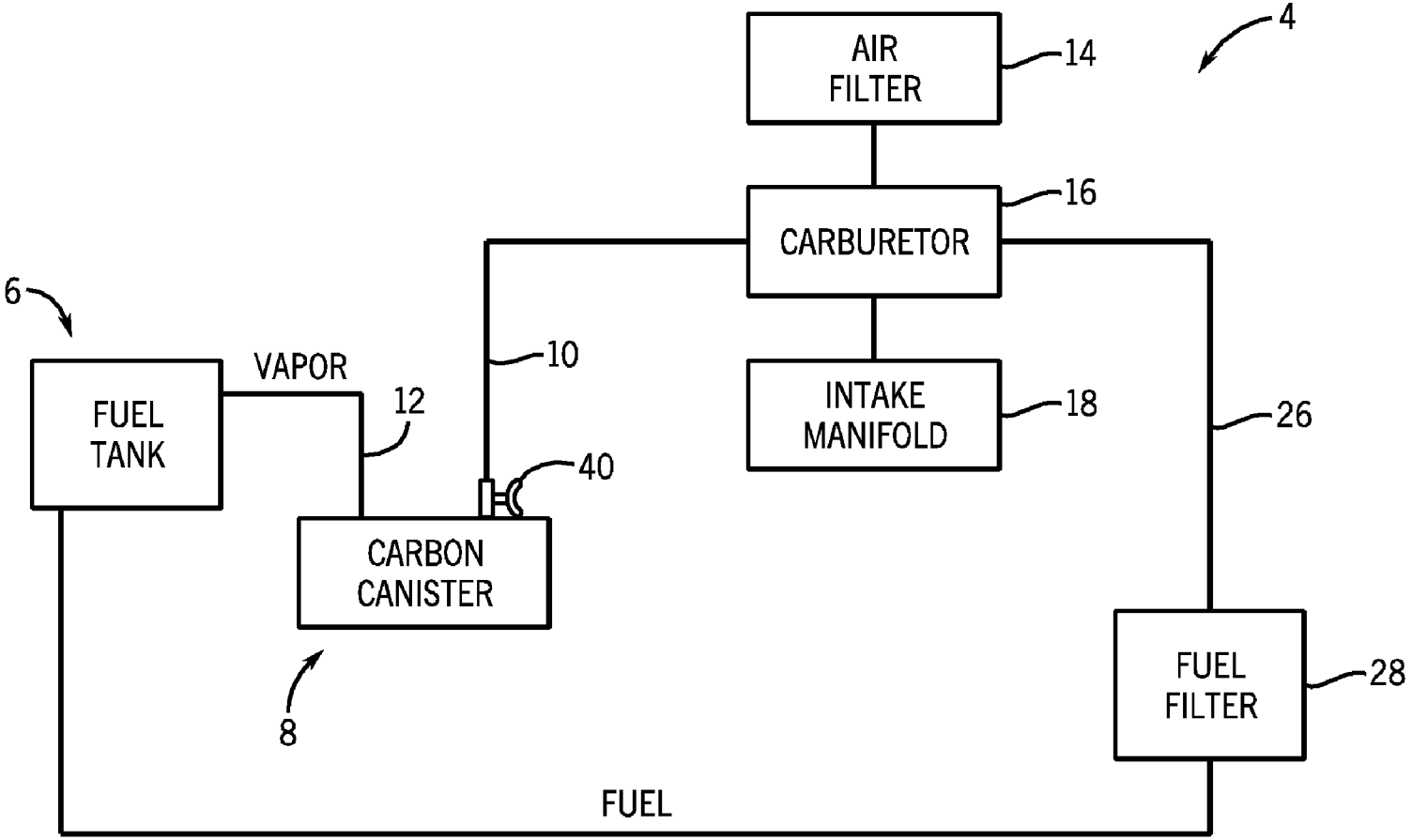
FIGS. 4A-D are schematic illustrations of various exemplary placement locations of the flow control device when positioned and/or used in conjunction with the system of FIG. 1A, in accordance with at least some embodiments of the present invention.
Figure 4B:
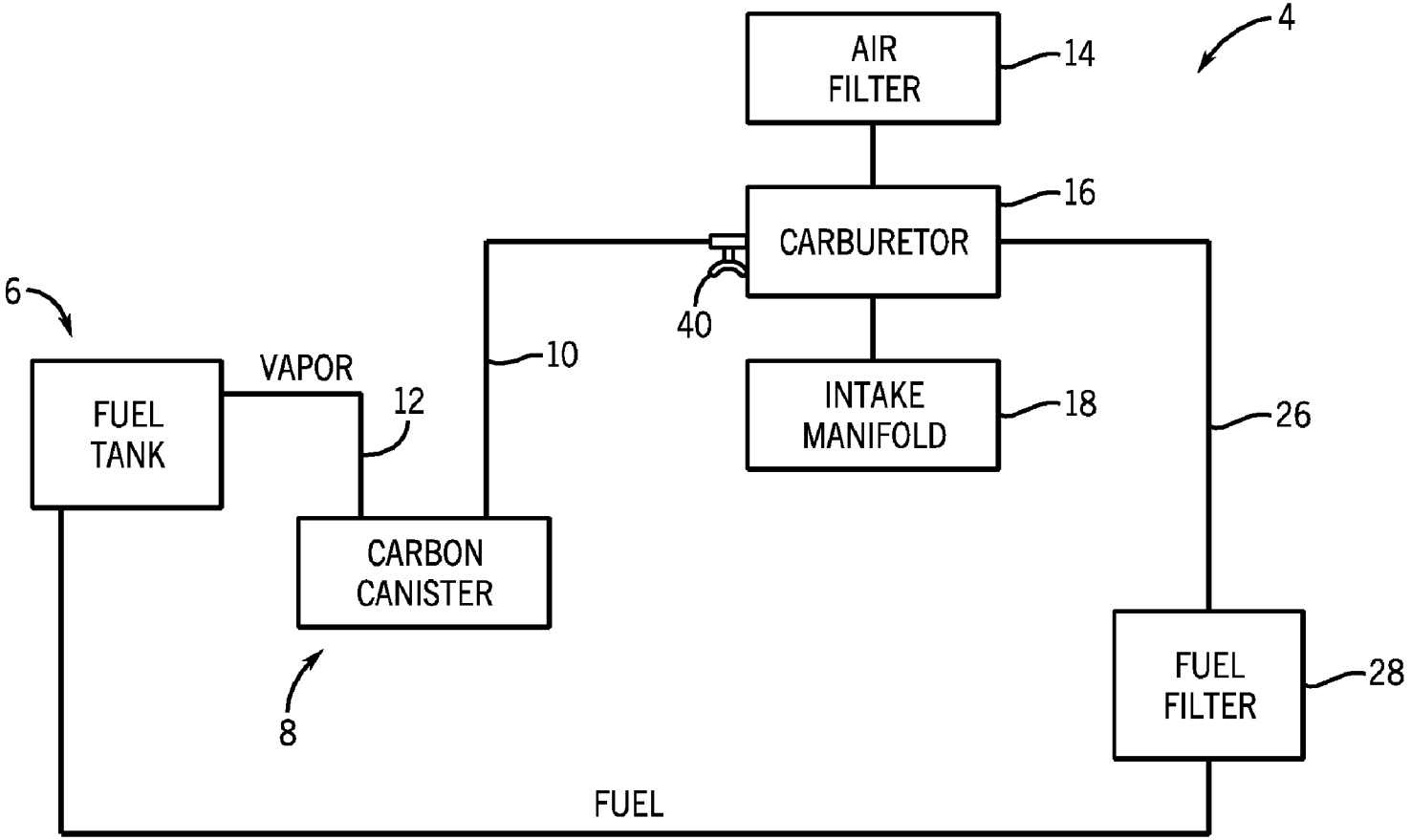

FIG. 4A shows the first embodiment of the flow control device 40 as being placed at, or adjacent, to the evaporative emissions control device 8 on the purge line 10. By virtue of placing the first embodiment of the flow control device 40 at or near the evaporative emissions control device 8, the purge flow rate can be controlled as the fuel vapors exit the evaporative emissions control device 8. FIG. 4B shows the first embodiment of the flow control device 40 to be located adjacent to a purge port on the purge line 10 of the carburetor 16. In particular, the purge port can be any location within the carburetor 16 where the fuel vapors coming from the evaporative emissions control device 8 can enter the carburetor. For example, the purge port can be located at the venturi region supplying the purged fuel component (in addition to the fuel supplied through the fuel nozzle) to mix with the intake air. Additionally, the purge port can be located above the venturi region such that intake air from the air filter 14 and the purged fuel component are mixed together as the mixture makes way to the venturi region for mixing with additional fuel from the fuel nozzle. Alternatively, the purge port can be located downstream of the venturi region within the carburetor 16 for mixing with the charge as it exits the carburetor.

Figure 4C:
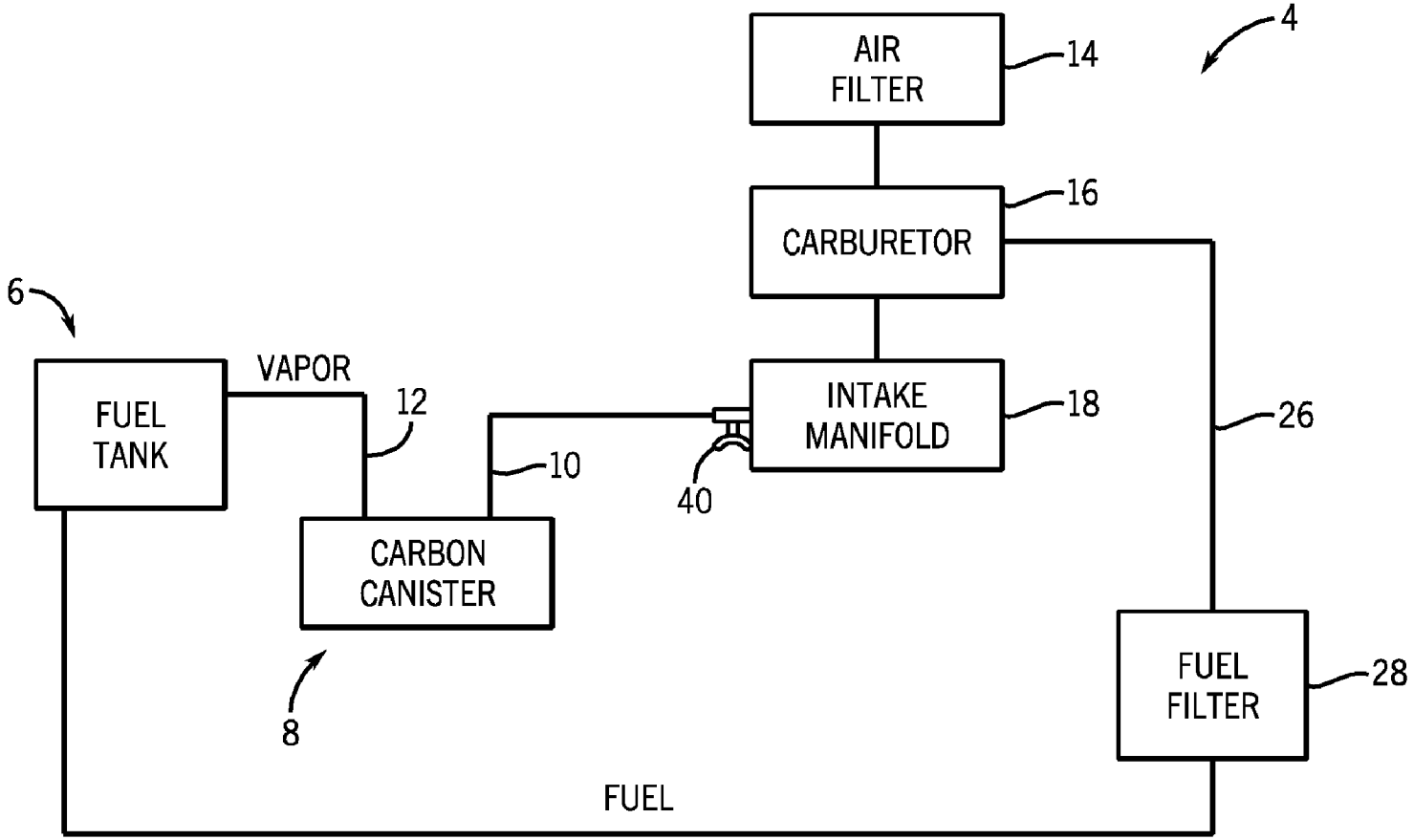
Figure 4D:
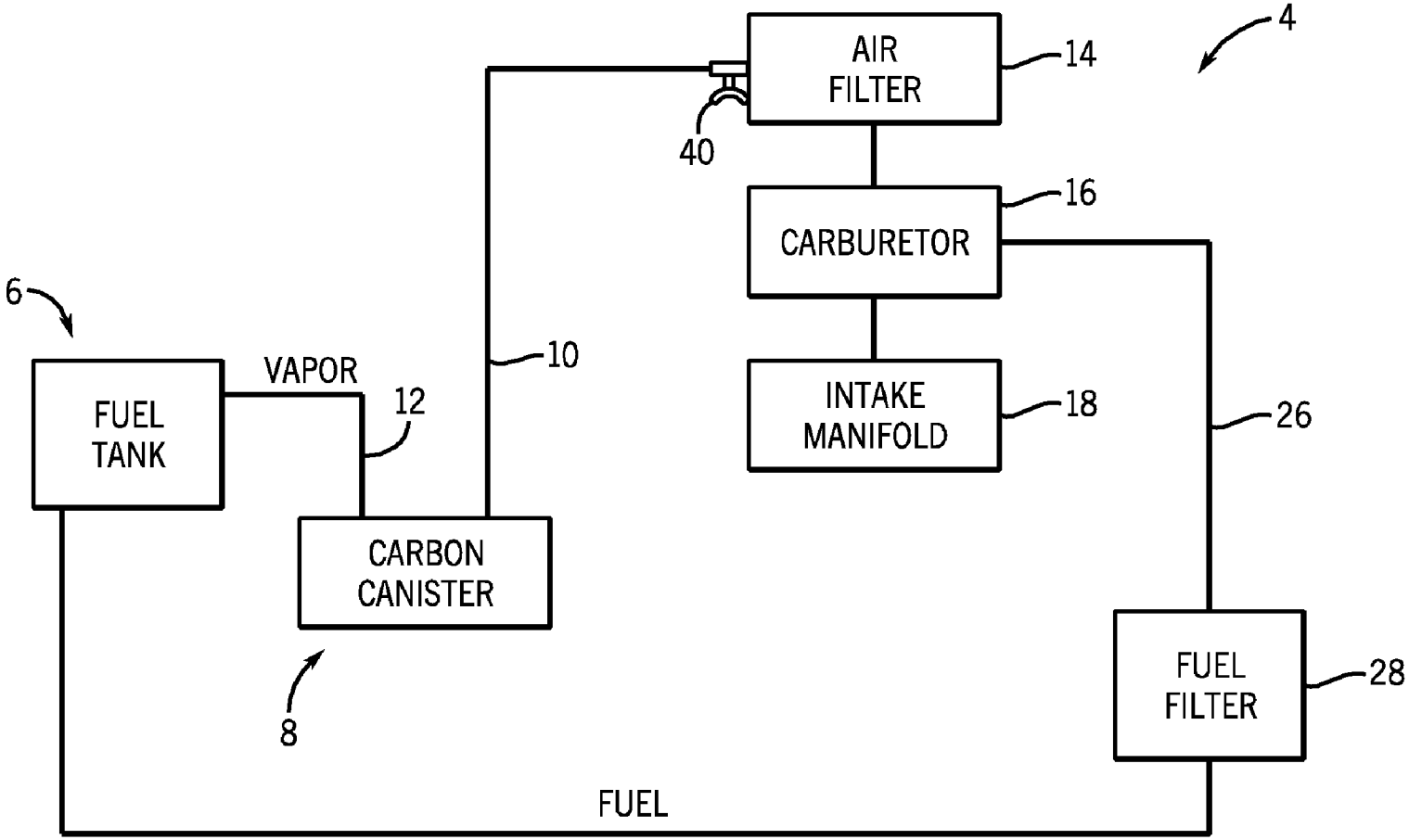

Further still, as shown in FIG. 4C, the first embodiment of the flow control device 40 can be placed at the intake manifold 18 for controlling the purge rate. The purged fuel component flows directly into the combustion chamber along with the charge produced in the venturi region of the carburetor 16. And as shown in FIG. 4D, the first embodiment of the flow control device 40 can be connected to the air filter 14. More specifically, the first embodiment of the flow control device 40 is typically connected, as shown, adjacent to the air inlet ports in the air filter. Notwithstanding the placement locations of the first embodiment of the flow control device 40 described above, in at least some embodiments of the present invention, placing the first embodiment of the flow control device adjacent to the purge port of the carburetor 16 and, more particularly, to the purge port located downstream of the venturi region (e.g., near a throttle plate of the carburetor), is preferred. Nevertheless, other placement locations of the first embodiment of the flow control device described above can be employed in alternate embodiments.

Figure 5A:
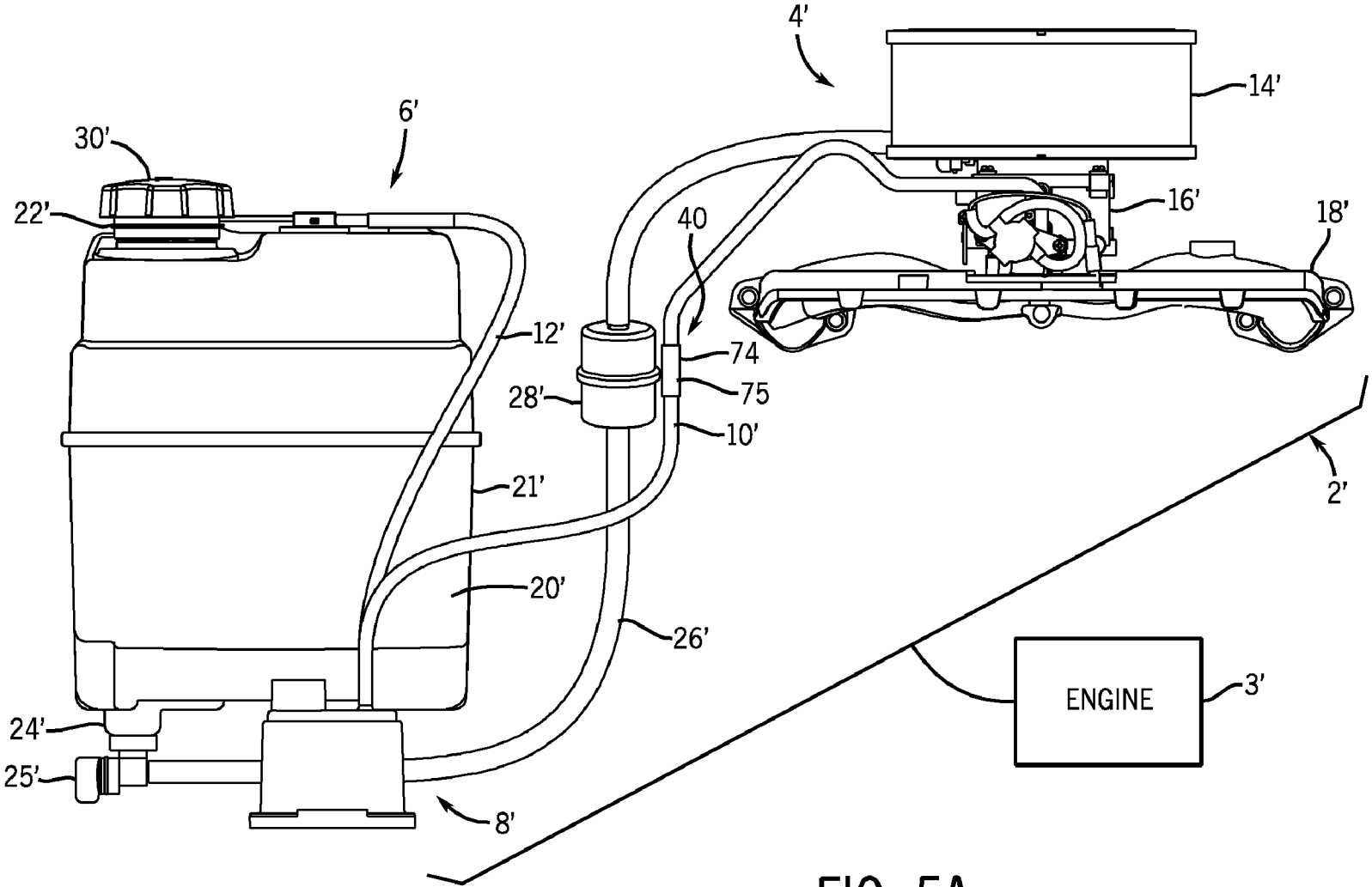
FIG. 5A is a front view of an evaporative emissions control system employing a second embodiment of the flow control device for controlling the purge flow rate of evaporative emissions, in accordance with at least some alternate embodiments of the present invention.

The evaporative emissions system 2 need not always be employed with the first embodiment of the flow control device 40, as described above. Rather, as shown in FIG. 5A from a front view, an evaporative emissions control system 2' can employ a second embodiment of the flow control device 40, in accordance with at least some alternate embodiments of the present invention. As shown, the flow control device 40 is a filter device, and, more specifically, in accordance with at least some embodiments of the present invention, a sintered filter 74. The evaporative emissions control system 2' is intended for use in conjunction with an engine 3'. Further as shown, the evaporative emissions control system 2' includes an air intake assembly 4', a fuel tank assembly 6' and an evaporative emissions control device 8' connected together in operational association. The air intake assembly 4' includes an air filter 14', a carburetor 16', and an intake manifold 18' connected at least indirectly to one another. Further, the air intake assembly 4' is in fluid communication with the evaporative emissions control device 8' via a purge line 10' and with the fuel tank assembly 6' via a fuel line 26' and an optional fuel filter 28'. Additional components including a fuel tank 20', fuel tank housing 21', fuel tank input and output ports 22' and 24', respectively, fuel tank cap 30' and fuel shut-off valve 25' are similar or substantially similar in structure and function to that of the corresponding components 20, 21, 22, 24, 30 and 25 respectively of the evaporative emissions control system 2. In general, with the exception of the first embodiment of flow control device, which is not used in the evaporative emissions control system 2', features, components and functionality of the evaporative emissions control system 2' closely mirror the features, components and functionality of the evaporative emissions control system 2. Further, the communication between the various components of the evaporative emissions control system 2' occurs in a manner similar or substantially similar to that of the communication between the corresponding components in the evaporative emissions control system 2.

Figure 5B:
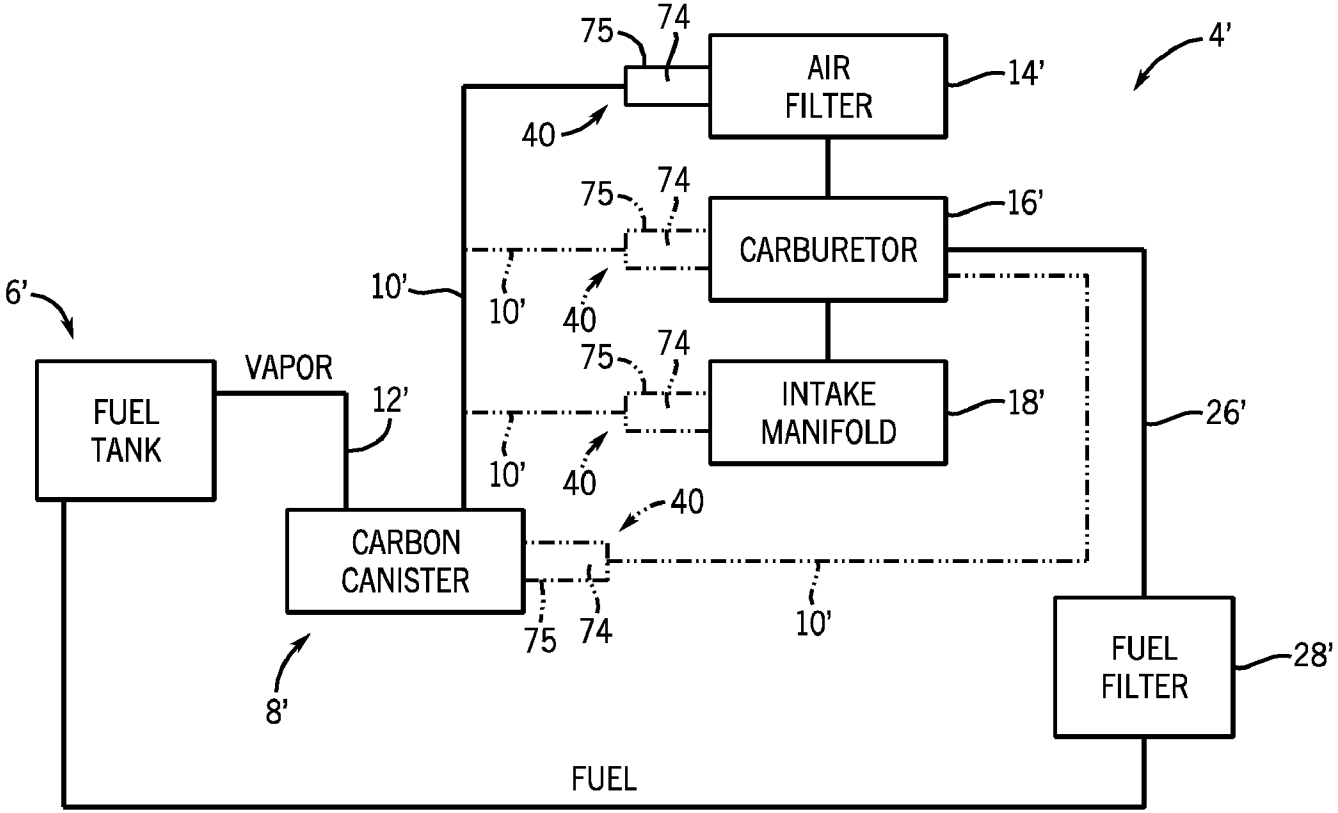
FIG. 5B is a schematic illustration of various exemplary placement locations of the flow control device of when positioned and/or used in conjunction with the system of FIG. 5A, in accordance with at least some embodiments of the present invention.

In contrast to the first embodiment of the flow control device 40 used in the embodiments of FIGS. 1-4D, the embodiments of FIGS. 5A-5B employ a second embodiment of the flow control device, such as, the sintered filter 74, for controlling and regulating the purge flow rate. It is noted that the sintered filter 74 is an exemplary filter device provided in accordance with the second embodiment of the flow control device and in accordance with at least some aspects of the invention. The sintered filter 74 is located on the purge line 10' and is coupled at least indirectly to the evaporative emissions control device 8' and the air intake assembly 4'. A type of sintered filter that can be employed in at least some embodiments of this invention is a sintered metal filter. Such a sintered metal filter can be manufactured by heating and compressing metal powder. In particular, a sintered metal filter can be produced by compressing metal powder into a shape (e.g., a cylindrical shape, a rectangular shape, etc.) and subsequently heating the shape in a furnace for sintering (e.g., welding together) the compressed metal powder. By virtue of the sintering operation, the shape obtained by compressing the metal powder is retained and maintained for extended periods of time. Insofar that the compressed powder does not completely melt to form a solid block, a plurality of small air passages (also referred to as ports) 75 are created in the sintered shape.

Further, the size of the air passages (or ports) 75 in the sintered shape can be varied by controlling the density of the compressed metal powder employed for making the sintered metal filter. Typically, as the density of the sintered filter 74 increases, the flow area through the air passages 75 decreases, thus restricting flow and controlling the purge flow rate. Additionally, as the cross section of the air passages 75 (e.g., having a cylindrical shape) in the flow direction decreases, the flow (e.g., the purge flow rate) is restricted. The geometry (e.g., length) of the sintered filter 74 additionally affects the purge flow rate, such that a longer filter typically restricts flow (and therefore controls the purge flow rate).

In particular, the size of the air passages 75 is typically determined in reaction to the evaporative emissions control device 8' and the fuel tank assembly 6'. A typical metal that can be used for manufacturing the sintered metal filter of the present embodiment is bronze, although, other metals such as stainless steel, and non-metals such as glass, can potentially be used in other embodiments. Although an exemplary sintered metal filter that can be used in at least some embodiments of the present invention has been described above, in other embodiments, a wide variety of sintered filters that are commonly available and frequently used, can be used in other embodiments. In addition, the shape and size of the sintered filter 74 can vary depending upon the application, type of engine 3' employing the sintered filter and location of the sintered filter within the evaporative emissions control system 2'.

As indicated above, the sintered filter 74 of the type employed in at least some embodiments of the present invention includes a plurality of air passages 75. The air passages 75 can be utilized for regulating the purge flow rate of the evaporative emissions control device 8'. Additionally, the air passages 75 of the sintered filter 74 remain open at all times during regulating the purge flow rate of the evaporative emissions control device 8'. In so far that the air passages 75 remain open at all times, the sintered filter 74 does not employ a valve or a valve-like mechanism that is capable of being opened and closed depending upon various conditions of the system employing the valve or the valve-like mechanism. By virtue of utilizing such a sintered filter having a plurality of air passages open during the regulating of the purge flow rate, various fuel tank sizes and various evaporative emissions control devices can be accommodated by only changing the sintered filter 74.

In addition to regulating the purge flow rate, the sintered filter 74 can be used for cleaning the intake air and/or the purge air. Particularly, during operation, the evaporative emissions control system 2' receives additional air from the outside atmosphere for purging the fuel vapors from the evaporative emissions control device 8' into the engine. Insofar that the purged air is routed to the air intake assembly 4' of the engine 3' when the engine is running, the sintered filter 74 can be used for filtering the purged air. By filtering the purged air, the sintered filter removes any residual dust and debris that can otherwise enter the air intake assembly 4' thereby causing clogs and blockages, which can reduce engine performance. Therefore, in addition to regulating the purge flow rate, the sintered metal filter provides an additional advantage of cleaning the purged air. Relatedly, the sintered filter 74 can clean the intake air depending upon the placement of the sintered filter within the evaporative emissions control system 2', as explained below.

Therefore, in accordance with at least some embodiments of the present invention, the sintered filter 74 can be provided for regulating the purge flow rate and cleaning the evaporative emissions in the evaporative emissions control system 2'. By virtue of having the sintered filter 74 having a plurality of air passages 75 formed therein by the process described above, the purged flow rate can be regulated. Additionally, the air sintered filter 74 can be used for cleaning the purged air.

Referring now to FIG. 5B, exemplary placement locations of the second embodiment of the flow control device 40 (e.g., the sintered filter 74) on the purge line 10' are shown, in accordance with at least some embodiments of the present invention. Also shown in schematic form in FIG. 5B, are various components of the evaporative emissions control system 2' including, for example, the air intake assembly 4', the evaporative emissions control device 8', and the fuel tank assembly 6', connected together in operational association with one another. In particular, the evaporative emissions control device 8' is in fluid communication with the fuel tank assembly 6' by way of the vapor line 12' and with the air intake assembly 4' by way of the purge line 10'. In addition, the fuel tank assembly 6' is in fluid communication with the air intake assembly 4' via the fuel line 26' and an optional fuel filter 28'. The air intake assembly 4' further includes the air filter 14', the carburetor 16' and the intake manifold 18' connected at least indirectly and capable of communication with one another.

As indicated above, the location of the second embodiment of the flow control device 40 (e.g., the sintered filter 74 filter device) within the evaporative emissions control system 2' for controlling the purge flow rate of the fuel vapors from the evaporative emissions control device 8' into the engine 3' (See FIG. 5A) can vary. For example, as shown in FIG. 5B, the second embodiment of the flow control device 40 (e.g., the sintered filter 74) can be placed at, or adjacent to, the air filter 14'. In addition to placing the second embodiment of the flow control device 40 at, or adjacent to, the air filter 14', the second embodiment of the flow control device can also be placed in a plurality of alternate locations, which are shown in phantom in FIG. 5B. For example, in at least some embodiments, the second embodiment of the flow control device 40 (e.g., the sintered filter 74) can be placed at, or adjacent to, the evaporative emissions control device 8'. By virtue of placing the second embodiment of the flow control device 40 near the evaporative emissions control device 8, the purged air can be filtered and regulated as fuel vapors exit the evaporative emissions control device. In some other embodiments, the second embodiment of the flow control device 40 (e.g., the sintered filter 74) can be placed adjacent to a purge part on the purge line 10' of the carburetor 16'. As previously mentioned in relation to the first embodiment of the flow control device 40 (e.g., the orifice connector 41), the location of the purge port within the carburetor 14' can vary. For example, the purge port (and hence, the second embodiment of the flow control device) can be located at, above, or potentially below the venturi region of the carburetor 14'. Alternatively, the second embodiment of the flow control device 40 (as shown, the sintered filter 74) can be placed at the intake manifold 18' for regulating the purged flow rate. Furthermore, as shown in FIG. 5A, in at least some embodiments, the sintered filter 74 can be positioned intermediate (or substantially intermediate) between the carburetor 16' and the evaporative emission control device 8'.

The operation of the evaporative emissions control systems 2 and 2' is explained below. In general, the operation of both evaporative emissions control systems 2 and 2' employing the first embodiment of the flow control device 40 (e.g., the orifice connector 41) and the second embodiment of the flow control device (e.g., the sintered filter 74), respectively, is similar or substantially similar. For clarification purposes, the operation is explained with respect to the evaporative emissions control system 2, with the reference numerals of the corresponding components of the evaporative emissions control system 2' given in parenthesis.

When the engine is not in operation fuel vapors including a fuel component and a hydrocarbon component collected above the liquid fuel within the fuel tank 20 (20') pass through the vapor line 12 (12') and into the evaporative emissions control device 8 (8') at least in part due to pressure differentials. Thereafter, fuel vapors are adsorbed in the adsorbent material. By virtue of the fuel vapors being adsorbed and therefore trapped within the evaporative emissions control device 8 (8'), evaporative emissions, which in the absence of the evaporative emissions control device would have been emitted into the atmosphere, are trapped. At any instant when the engine is running and the internal pressure within the evaporative emissions control device 8 (8') is higher than the internal pressure of the intake system (also referred herein as the air intake assembly 4) at the purge port location, the trapped fuel vapors can be purged into the engine. The purge rate of the trapped fuel vapors can be controlled by way of the flow control device (e.g., the orifice connector 41 and/or the sintered filter 74). Typically, the purging action involves drawing atmospheric air within the evaporative emissions control device 8 (8') through the fresh air port. The air flow facilitates the purging action of the fuel vapors from the evaporative emissions device 8 (8') to the engine whereby the fuel component from the fuel vapors is recovered. Alternatively, as the fuel tank 20 (20') has cooled down due to non-use over extended periods of time or when the engine is not running, the pressure differentials within the evaporative emissions control device 8 (8') and the fuel tank can cause the fuel component to be recovered from the adsorbent material and flow back to the fuel tank thereby reducing fuel wastage and reducing/eliminating evaporative emissions.

Notwithstanding the above-described embodiments, the present invention is intended to encompass a variety of other arrangements of orifice connectors and sintered filters within the evaporative emissions control system. For example, although the embodiments of FIGS. 1-4D do not illustrate the use of multiple orifices, it is nevertheless contemplated that the present invention encompasses and includes embodiments having more than one orifice.

Additionally, the embodiments of the flow control device, as illustrated and previously noted, are exemplary in nature. Notwithstanding the various embodiments of the flow control device described above in relation to the orifice device (e.g., the orifice connector) and the filter device (e.g., the sintered filter), respectively, in at least some other embodiments of the present invention, the flow control device can be formed as a plug-like or a cork-like device ("plug/cork device") having an orifice for regulating the purge flow rate. In embodiments employing such a plug/cork device having an orifice, the device can be positioned or otherwise placed within the purge line for regulating the purge flow rate. Additionally, the plug/cork device can be positioned within the purge line at one or more locations described above with respect to FIGS. 4A-4D. In at least some alternate embodiments of the present invention, the flow control device can be formed (e.g., integrally) within the purge line, for example, by way of crimping or otherwise squashing the purge line so as create a pinch point within the purge line that can be utilized for regulating the purge flow rate. The size of the pinch point, or alternatively, the size of the orifice within such a plug/cork device, can vary to convenience depending upon the desired purged flow rate. In general, the flow control device in various of its embodiments can be located within various areas of the evaporative emissions control system, including for example, the carburetor purge port, the evaporative emissions control device, the evaporative line, or the like.

Further, as already noted, the exact shapes and sizes of the orifice connector, fuel tanks, evaporative emissions control device and/or the various components of the air intake assembly can vary with a given embodiment. Relatedly, a plurality of sintered filters of varying shapes and sizes can be employed in the embodiments of FIGS. 5A-5B, with the location of one or more sintered filters varying from that described above. Further, in at least some embodiments, a combination of orifice connectors and sintered filters can be used for regulating the purged flow rate. Additionally, in at least some embodiments of the present invention, the orifice connector and the sintered filter can be retrofitted to the purge line for regulating the purge flow rate. Also, in at least some other embodiments of the present invention, the evaporative emissions system can employ a single evaporative emissions control device while other embodiments can employ multiple evaporative emissions control devices.

The present invention relates to a variety of embodiments of fuel tanks, evaporative emissions control devices, air intake assemblies and flow control devices as can be employed in a variety of applications and for a variety of purposes. For example, embodiments of the present invention can be employed in conjunction with a variety of different internal combustion engines used in vehicles, or for a variety of other purposes. Embodiments of the present invention can be particularly beneficial insofar as they reduce or even eliminate evaporative emissions from the fuel.

Also, it is contemplated that embodiments of the present invention are applicable to engines that have less than one liter in displacement, or engines that both have less than one liter in displacement and fit within the guidelines specified by the above-mentioned regulations. In still further embodiments, the present invention is intended to encompass other small engines, large spark ignition (LSI) engines, and/or other larger (mid-size or even large) engines. In additional embodiments, the present invention is intended to be used with containers or storage tanks other than fuel tanks holding volatile fluids, which are producers of volatile organic compounds (VOC) or evaporative emissions. In alternate embodiments, the present invention is contemplated for use with Electronic Fuel Injection (EFI) systems, in which the purged fuel vapors pass through an EFI throttle body of the engine.

Despite any method(s) being outlined in a step-by-step sequence, the completion of acts or steps in a particular chronological order is not mandatory. Further, modification, rearrangement, combination, reordering, or the like, of acts or steps is contemplated and considered within the scope of the description and claims.

It is specifically intended that the present invention not be limited to the embodiments and illustrations contained herein, but include modified forms of those embodiments including portions of the embodiments and combinations of elements of different embodiments as come within the scope of the following claims.

We claim:

1. An evaporative emissions system for regulating a purge flow rate in an internal combustion engine, the system comprising:

an air intake assembly for providing a mixture of intake air and fuel to the internal combustion engine;

an evaporative emissions control device having a first port and a second port and for purging fuel vapors, the evaporative emissions control device in fluid communication with the air intake assembly;

a fuel tank assembly for providing fuel to the air intake assembly, the fuel tank assembly in fluid communication with (i) the first port of the evaporative emissions control device and (ii) the air intake assembly; and a flow control device for regulating a purge flow rate of the evaporative emissions control device, the flow control device being at least indirectly connected between the second port of the evaporative emissions control device and the air intake assembly;

wherein the flow control device includes at least one of an orifice and a passageway that is sized in relation to at least one of the evaporative emissions control device and the fuel tank assembly;

wherein all fuel vapors directed from the evaporative emissions control device to the air intake assembly pass through the flow control device; and wherein the at least one of an orifice and passageway remains open during regulating of the purge flow rate of fuel vapors between the evaporative emissions control device and the air intake assembly.

2. The system of claim 1, wherein the flow control device includes a connector device, the connector device having a channel terminating in an orifice and communicating at least indirectly with the evaporative emissions control device and the air intake assembly for regulating the purge flow rate, the connector device not including any valve or a valve-like mechanism.

3. The system of claim 1, wherein the flow control device includes a filter device having a plurality of air passages for regulating the purge flow rate by varying the size of the plurality of air passages, the filter device not including a valve or a valve-like mechanism.

4. The system of claim 1, wherein the air intake assembly comprises: (i) an air filter for receiving intake air from the outside atmosphere, (ii) a carburetor located downstream of the air filter and coupled at least indirectly to the air filter, the carburetor being capable of mixing air and fuel together to produce an air-fuel mixture, and (iii) an intake manifold located downstream of the carburetor and coupled at least indirectly to the carburetor, the intake manifold capable of transporting the air-fuel mixture to the engine.

5. The system of claim 1, wherein the evaporative emissions control device includes a carbon canister, the carbon canister including a housing for receiving fuel vapors, the housing further having (i) an inner chamber containing an adsorbent material capable of adsorbing fuel vapors and (ii) a plurality of ports including: (a) the first port for communicating with the fuel tank assembly for receiving fuel vapors therefrom; (b) a third port for communicating with the outside atmosphere for purging the fuel vapors received via the first port; and (c) the second port for communicating with the air intake assembly for transporting the purged fuel vapors thereto.

6. The system of claim 1, wherein a single evaporative emissions control device is used for purging fuel vapors in conjunction with the flow control device.

7. The system of claim 1, wherein the fuel tank assembly includes a housing having an inner chamber capable of containing a liquid fuel, the housing further providing for an air space above the upper surface of the liquid fuel when the housing contains the fuel, the air space for collecting liquid fuel vapors, wherein the housing can further include a vent having a vent opening for transferring fuel vapors from the fuel tank assembly to the evaporative emissions control device.

8. The system of claim 1, wherein the fluid communication between the air intake assembly, the evaporative emissions control device and the fuel tank assembly includes at least one of (i) a vapor line or conduit connecting the fuel tank assembly and the first port of the evaporative emissions control device; (ii) a fuel line or conduit connecting the fuel tank assembly and the air intake assembly; and (iii) a purge line or conduit connecting the second port of the evaporative emissions control device and the air intake assembly.

9. The evaporative emissions system of claim 1, wherein the flow control device is positioned intermediate or substantially intermediate between the air intake assembly and the evaporative emissions control device and wherein the evaporative emissions control device receives fuel vapors from the fuel tank.

10. A connector device comprising:

a channel section, the channel section having at least one channel terminating in at least one orifice, the orifice for regulating an evaporative emission purge flow rate of fuel vapors directed from an evaporative emissions control device to an air intake assembly of an internal combustion engine, the regulating occurring without any valve or valve-like mechanism, wherein the orifice remains open when regulating the purge flow rate, and wherein all fuel vapors directed from the evaporative emissions control device to the air intake assembly pass through the orifice.

11. The connector device of claim 10, wherein the channel section further includes a first portion and a second portion, each of the first and the second portions having at least one orifice such that fuel vapors enter the connector device through the at least one orifice of the first portion and exit through the at least one orifice of the second portion for regulating the purge flow rate into the internal combustion engine.

12. The connector device of claim 10, further comprising a frusto-conical portion and a cylindrical portion, at least one of the frusto-conical and cylindrical portions having the at least one orifice for receiving fuel vapors.

13. The connector device of claim 10, further comprising a support section connected at least indirectly to the channel section, the support section further comprising: a first portion and a second portion, the first and second portions being connected by a support section support member; and a connector portion for connecting the channel section to the support section.

14. The connector device of claim 13, wherein the first and the second portions and the connector portion of the support section include at least one of the following: (i) the first portion of the support section including either an anchor or a flat-arrow shape; (ii) the second portion of the support section including an arched member for providing support to the channel section; and (iii) the connector portion having a cylindrical portion at least partially surrounding the channel section and a tubular portion extending from the cylindrical portion, the tubular portion in mating alignment with the support section.

15. A method of regulating purge flow rate associated with evaporative emissions in an internal combustion engine, the method comprising, providing an air intake assembly, a fuel tank assembly, and an evaporative emissions control device in operational association with each other, as well as a flow control device that is connected at least indirectly to the evaporative emissions control device and the air intake assembly, the flow control device including at least one of an orifice and a passageway, the at least one of an orifice and passageway sized in relation to at least one of the evaporative emissions control device and the fuel tank assembly, wherein a first port of the evaporative emissions control device is connected to the fuel tank assembly and the flow control device is connected between a second port of the evaporative emissions control device and the air intake assembly;

receiving fuel vapors at least indirectly from the fuel tank assembly and into the evaporative emissions control device; and purging the fuel vapors from the evaporative emissions control device using the flow control device so as to regulate the purge flow rate of all fuel vapors directed from the evaporative emissions control device to the air intake assembly;

wherein all fuel vapors directed from the evaporative emissions control device to the air intake assembly pass through the flow control device; and wherein the at least one of an orifice and passageway remains open during regulating the purge flow rate of fuel vapors between the evaporative emissions control device and the air intake assembly.

16. The method of claim 15, wherein the purging of the fuel vapors further comprises:

adsorbing the fuel vapors into an adsorbent media located within the evaporative emissions control device; and recovering the adsorbed fuel vapors from the adsorbent media by receiving air from exterior of the evaporative emissions control device into the inside of the evaporative emissions control device.

17. The method of claim 15, wherein the providing of the flow control device connected at least indirectly to the evaporative emissions control device and the air intake assembly further comprises providing a connector device having at least one orifice, and locating the connector device in at least one of the following: (a) adjacent the evaporative emissions control device; (b) adjacent a carburetor of the air intake assembly; (c) adjacent to an intake manifold of the air intake assembly; (d) adjacent an air filter of the air intake assembly; and (e) intermediate or substantially intermediate between the evaporative emissions control device and the carburetor.

18. The method of claim 15, wherein the providing of the flow control device connected at least indirectly to the evaporative emissions control device and the air intake assembly further comprises providing a filter device, the filter device having a plurality of air passages, such that the size of the plurality of air passages can be varied for (i) regulating the purge flow rate; and (ii) cleaning the purged fuel vapors and outside air received via the air intake assembly; and further providing the filter device having the plurality of air passages in at least one of the following: (a) adjacent the evaporative emissions control device; (b) adjacent a carburetor of the air intake assembly; (c) adjacent to an intake manifold of the air intake assembly; (d) adjacent an air filter of the air intake assembly and (e) intermediate or substantially intermediate between the evaporative emissions control device and the carburetor.

19. The method of claim 15, wherein the purge flow rate can be regulated without requiring re-calibration of a carburetor in an internal combustion engine.

20. The method of claim 15, wherein regulating of the purge flow rate is accomplished without using a valve or a valve-like mechanism.

21. An engine in combination with an evaporative emissions system, the combination comprising:

an engine; and an evaporative emissions system comprising: an air intake assembly, a fuel tank assembly and an evaporative emissions control device in operational association with one another, and a flow control device connected at least indirectly to the evaporative emissions control device and the air intake assembly, the flow control device for regulating a purge flow rate of fuel vapors into the engine, the flow control device including an orifice that is sized in relation to at least one of the evaporative emissions control device and the fuel tank assembly;

wherein a first port of the evaporative emissions control device is connected at least indirectly to the fuel tank assembly and the flow control device is connected at least indirectly between a second port of the evaporative emissions control device and the air intake assembly, and wherein all fuel vapors directed from the evaporative emissions control device to the air intake assembly pass through the orifice.

22. The combination of claim 21, wherein the engine is an internal combustion engine, and wherein the evaporative emissions control device receives fuel vapors from the fuel tank, and the flow control device is selected from at least one of a connector device and a filter device.

23. A method of using a sintered metal filter for purging and cleaning evaporative emissions in an internal combustion engine, the method comprising:

providing a sintered metal filter having a plurality of passageways formed therein for receiving at least one of atmospheric air and purged fuel vapors;

using the plurality of passageways to regulate the purge flow rate and to clean purged evaporative emissions;

wherein the plurality of passageways remain open during the purging of the evaporative emissions, and wherein the providing of the sintered metal filter does not include providing a valve or a valve-like mechanism for use in or in conjunction with the filter.

24. The method of claim 23, wherein the at least one of the plurality of passageways is sized in relation to at least one of an evaporative emissions control device and a fuel tank assembly of the internal combustion engine so as to regulate the purge flow rate.

25. An evaporative emissions system for regulating a purge flow rate in an internal combustion engine, the system comprising:

an air intake assembly for providing a mixture of intake air and fuel to the internal combustion engine;

an evaporative emissions control device for purging fuel vapors, the evaporative emissions control device in fluid communication with the air intake assembly;

a fuel tank assembly for providing fuel to the air intake assembly, the fuel tank assembly in fluid communication with (i) the evaporative emissions control device and (ii) the air intake assembly; and a flow control device for regulating a purge flow rate of the evaporative emissions control device, the flow control device being at least indirectly connected to the evaporative emissions control device and the air intake assembly;

wherein the flow control device includes at least one of an orifice and a passageway that is sized in relation to at least one of the evaporative emissions control device and the fuel tank assembly;

wherein the at least one of an orifice and passageway remains open during regulating of the purge flow rate;

wherein the flow control device includes a connector device, the connector device having a channel terminating in an orifice and communicating at least indirectly with the evaporative emissions control device and the air intake assembly for regulating the purge flow rate, the connector device not including any valve or a valve-like mechanism; and wherein a single evaporative emissions control device is used for purging fuel vapors in conjunction with the flow control device.

26. An evaporative emissions system for regulating a purge flow rate in an internal combustion engine, the system comprising:

an air intake assembly for providing a mixture of intake air and fuel to the internal combustion engine;

an evaporative emissions control device for purging fuel vapors, the evaporative emissions control device in fluid communication with the air intake assembly via a purge line extending therebetween, with the purge line not including any valve or a valve-like mechanism;

a fuel tank assembly for providing fuel to the air intake assembly, the fuel tank assembly in fluid communication with (i) the evaporative emissions control device and (ii) the air intake assembly; and a flow control device for regulating a purge flow rate of the evaporative emissions control device, the flow control device connected in series with the purge line;

wherein the flow control device includes at least one of an orifice and a passageway that is sized in relation to at least one of the evaporative emissions control device and the fuel tank assembly;

wherein the at least one of an orifice and passageway remains open during regulating of the purge flow rate, and wherein a first port of the evaporative, emissions control device is connected at least indirectly to the fuel tank assembly and the flow control device is connected at least indirectly between a second port of the evaporative emissions control device and the air intake assembly.

* * * * *